United States Patent [19]

Weintraub et al.

[11] 4,005,531

[45] Feb. 1, 1977

[54] FOOT COOLER

[76] Inventors: Morton Weintraub, 1542 47th St.; Bernard Gendelman, 1340 52nd St., both of Brooklyn, N.Y. 11219

[22] Filed: Aug. 11, 1975

[21] Appl. No.: 603,663

[52] U.S. Cl. ..... 36/28; 36/43

[51] Int. Cl.[2] ..... A43B 13/18; A43B 13/38

[58] Field of Search ..... 12/142 R; 36/2.5 R, 36/28, 35 R, 37, 25 R, 43, 44

[56] References Cited

UNITED STATES PATENTS

| | | | |
|---|---|---|---|
| 1,304,915 | 5/1919 | Spinney | 36/29 |
| 1,596,923 | 8/1926 | Cooney | 36/29 |
| 3,871,117 | 3/1975 | Richmond et al. | 36/43 |

*Primary Examiner*—Patrick D. Lawson

[57] ABSTRACT

A method of preventing feet from becoming hot and muggy by a process which is practical, comfortable, and beneficial. The method permits the subject to move about outdoors in the hot sun and/or indoors in a non-airconditioned building, during the summer months without the feet becoming hot or muggy. The method cools the subject's feet while he is running, climbing, jumping, standing, or sitting still. The method does not limit the subject's ambulation, neither does it restrain his body movements, nor does it restrict his mobility to a specific geographical area. The method contemplates and includes within its scope a pair of 'foot coolers' which consist of a pair of 'cool shoes' specially constructed with high outer platform soles that contain sufficient insulation and adequate vacant spaced (chamber) to house a durable, removable, lightweight, 'cool container' filled with a suitable, inexpensive refrigerant. The heat transfer from the feet above the separation of the inner sole passes through and on down to the 'cool container' where it is absorbed by the chilly refrigerant thereby cooling the feet above the inner sole of the 'cool shoe'. The method also increases the feet comfort of the subject by preventing the feet from expanding and by neutralizing the factors that cause feet perspiration and concomitant unpleasant feet odor.

The present method of preventing hot and muggy feet and cooling hot and muggy feet, is also applicable to the utilization of a miniature, mechanical, refrigerating device that uses a pump manipulated by the movement of the feet and that contains the basic parts of generator, separator, condenser, evaporator, and absorber.

1 Claim, 5 Drawing Figures

FOOT COOLER

BACKGROUND OF THE INVENTION

1. Field of the Invention

This invention relates to a method of preventing feet from becoming hot and muggy and to the 'foot coolers' employable with the same.

2. Description of the Prior Art

In the current methods of cooling hot, muggy feet the subject usually has the following options: to remove his shoes and socks thereby exposing it to the outside air and at the same time emitting unpleasant feet odors concomitant with perspiring feet; to bathe his feet with alcohol or in cold water, thereby wetting his feet and limiting his feet movements; to place it atop of an ice-bag or ice, thereby curtailing such activities as walking, running, jumping and climbing, while his feet is being cooled; or to be wired up in a space suit, similar to those worn by astronauts, which is awkward looking, expensive, and not for every day use and ordinary activites of daily living.

Under the current methods, the subject's hot, muggy feet could be cooled but at the expense of a considerable loss of freedom and/or mobility. Also these current methods of cooling would not prevent the subject's feet from becoming hot and muggy if he would don his socks and shoes, move about outdoors under the hot sun for any given distance, walk indoors or climb stairs in a heated building, or run, jump, stand or sit in any non-airconditioned area.

SUMMARY OF THE INVENTION

It is, therefore among one of the principal objectives of the invention to devise a method of preventing feet from becoming hot and muggy during the summer months, within all usually inhabited areas, that makes use of a pair of 'foot coolers' which consist of a pair of 'cool shoes' and a pair of 'cool containers'. The 'cool shoe' is specially constructed with a high outer platform sole that contains sufficient insulation of a flexible material and adeqaute vacant space(chamber) to house a durable, lightweight, suitable, removable 'cool container'. The 'cool container' is filled with an inexpensive, suitable, refrigerant which absorbs the heat transferred from the feet.

While for the ease of convenience, the specification will refer throughout the method as being applicable to a male shoe, 9 inches long, 3 inches wide, at the narrowest point, and containing ahigh platform outer sole that is 9½, inches long, 3½ inches wide, and 1¼ inches high, it should be understood that the present method is applicable to any and all other shoes, boots, sneakers, and footwear, designed to house a refrigerant, for men, women, and children, with various shapes, materials, dimensions, substances of insulation, and kinds of refrigerants.

In accordance with the invention, a pair of 'foot coolers' which include a pair of 'cool shoes' specially constructed with high outer platform soles that contain sufficient, flexible, insulation and adequate vacant space (chamber) to house a durable, light-weight, removable, suitable, 'cool container' filled with an inexpensive suitable refrigerant, are utilized to prevent feet from becoming hot and muggy during the hot summer months in all usually inhabited areas, whether or not the subject is outdoors in the hot sun or indoors in a hot non-airconditioned room; whether or not the subject is walking, running, climbing, jumping, standing or sitting still.

By the present method it has been found that the subject can move about, remain stationary or sedentary, outdoors as well as indoors, in all inhabitable areas without the limitations of ambulation, the restraints of movement, or the restrictions of mobility, that exist in the current methods of cooling hot muggy feet. Further, the subject, while wearing the 'foot coolers' to cool his feet, can prevent them from becoming hot and muggy for a considerable period of time, several consecutive hours. In addition to the above, it has been found that the subject's feet comfort can be increased, as the present method prevents his feet from expanding within the shoes, when the outdoor or indoor temperature reaches a temperature level that would normally cause the subject's feet to expand, if it were placed in an ordinary pair of shoes, and also neutralizes the factors that cause feet perspiration and concomitant unpleasant feet odor.

DESCRIPTION OF THE SPECIFIC EMBODIMENTS

A 'foot cooler' is a specially constructed 'cool shoe' and a 'cool container.' The 'cool shoe' is constructed with a high outer platform sole that contains sufficient, flexible, insulation and adequate vacant space (a chamber) to house a durable light-weight, removable, suitable 'cool container.' The 'cool container' is filled with an inexpensive, suitable refrigerant. The 'foot cooler' provides cooling and prevents the subject's foot from becoming hot and muggy. The subject places his foot within the 'foot cooler', in the same manner he would place his foot within an ordinary shoe. The foot above, is separated from the 'cool container' below, by a layer of leather joined to a soft, foamy, inner sole, which is insufficiently insulated to prevent the heat emitted from the foot to pass through the inner sole down to the chilly refrigerant, contained in the 'cool container'. This transfer of heat from the subject's foot to the chilly refrigerant is based upon the second law of thermodynamics which states that heat flows from warmer bodies to colder bodies or from a substance of higher temperature to a substance of a lower temperature. The right 'foot cooler' contains a 'cool shoe' and a 'cool container', which cools the subject's right foot. The left 'foot cooler' contains a 'cool shoe' and a 'cool container', which cools the subject's left foot. The 'foot coolers' are complete when the 'cool containers' are housed within the 'cool shoes' in a refrigerated condition.

Figure 1:
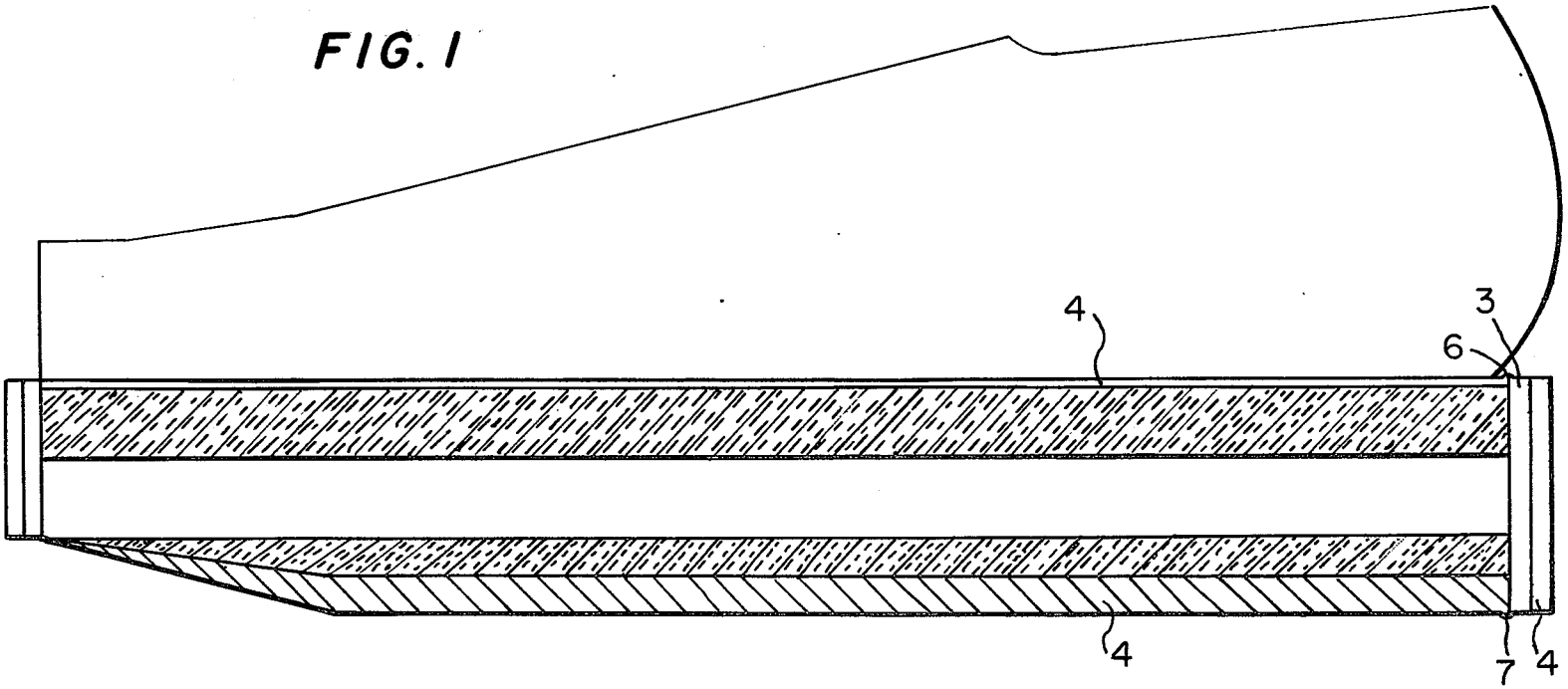

FIG. 1 contains a drawing of the side view of the right 'cool shoe', with the specially constructed high outer platform sole.

1 depicts the shoe compartment. 2 depicts the vacant space (chamber). 3 depicts the insulation layer. 4 depicts the leather layer. 5 depicts the rear paneling that is removable. 6 depicts the upper groove which holds the rear paneling from the top. 7 depicts the lower groove which holds the rear paneling from the bottom.

The high outer platform sole is the entire area depicted by numbers, 2 through 7.

Figures 2, 2A:
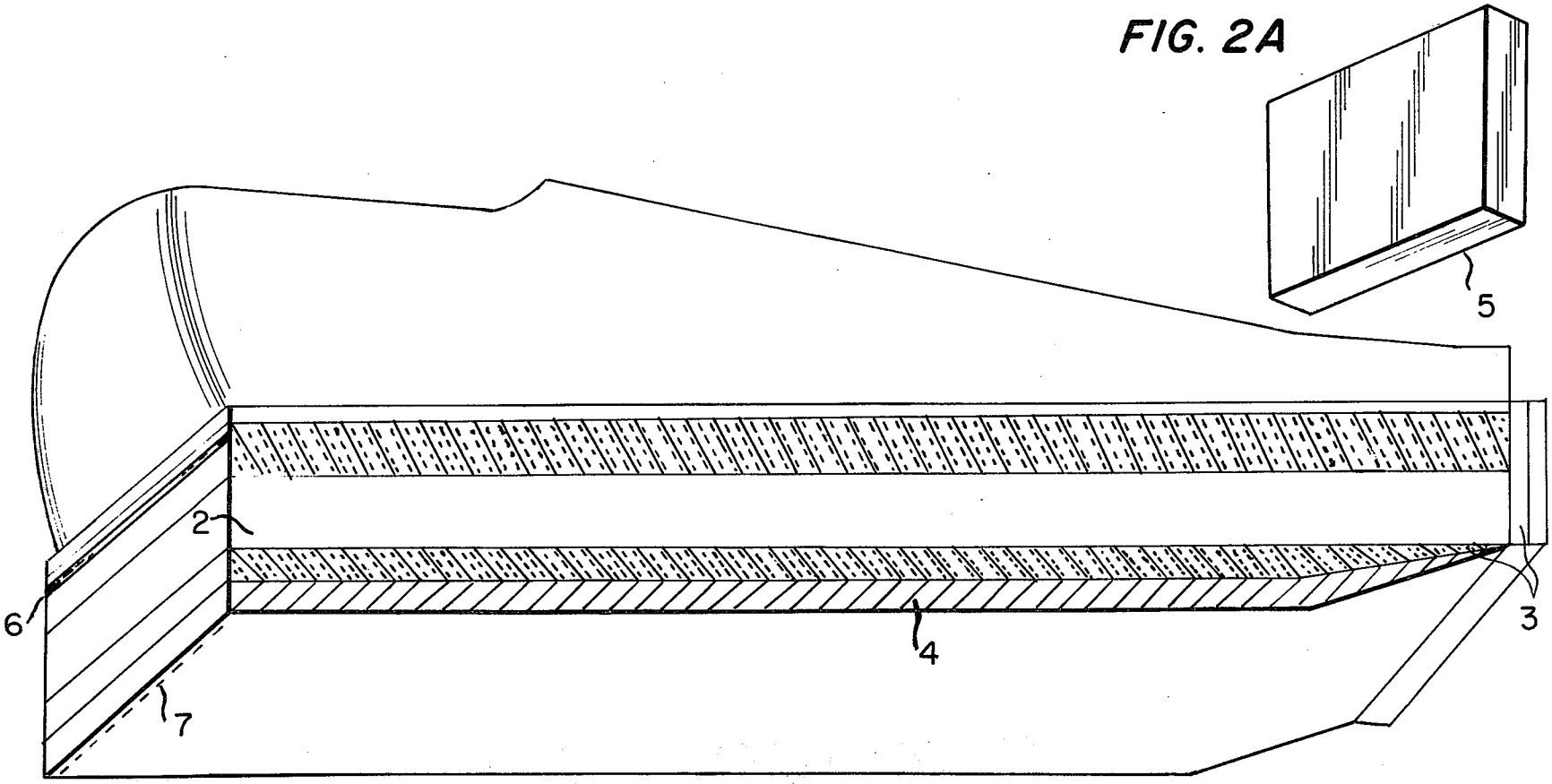
Figure 3:
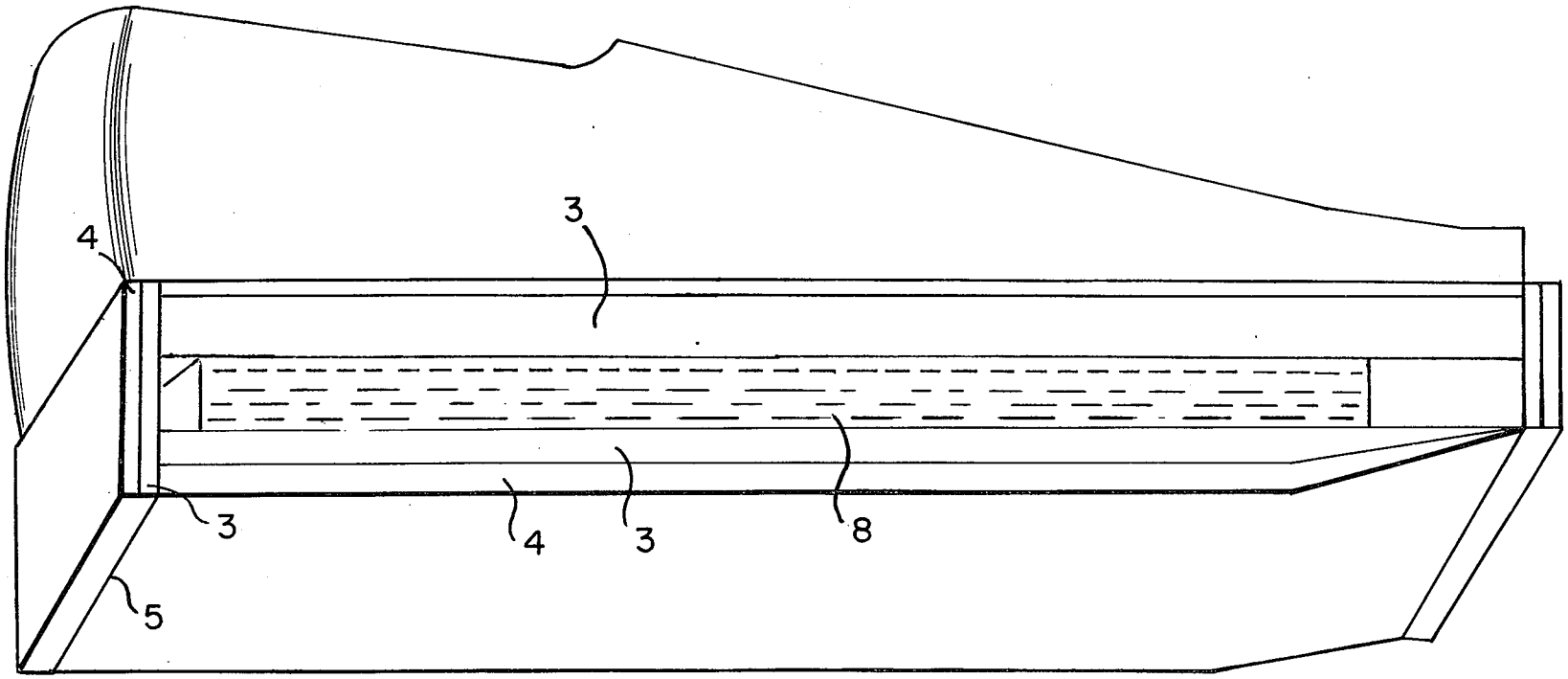

FIG. 2 and FIG. 2A contains a drawing of the bottom view of the high outer platform sole, without the 'cool container' housed within its place, within the vacant space (chamber). 2 depicts the vacant space (chamber) 3 depicts the insulation layer. 4 depicts the leather layer. 5 depicts the rear paneling removed. 6 depicts the upper groove which holds the rear paneling from the top. 7 depicts the lower groove which holds the rear paneling from the bottom. FIG. 3 contains a drawing of the bottom view of the high outer platform sole, with the 'cool container' housed within the vacant space (chamber).

Figure 4:
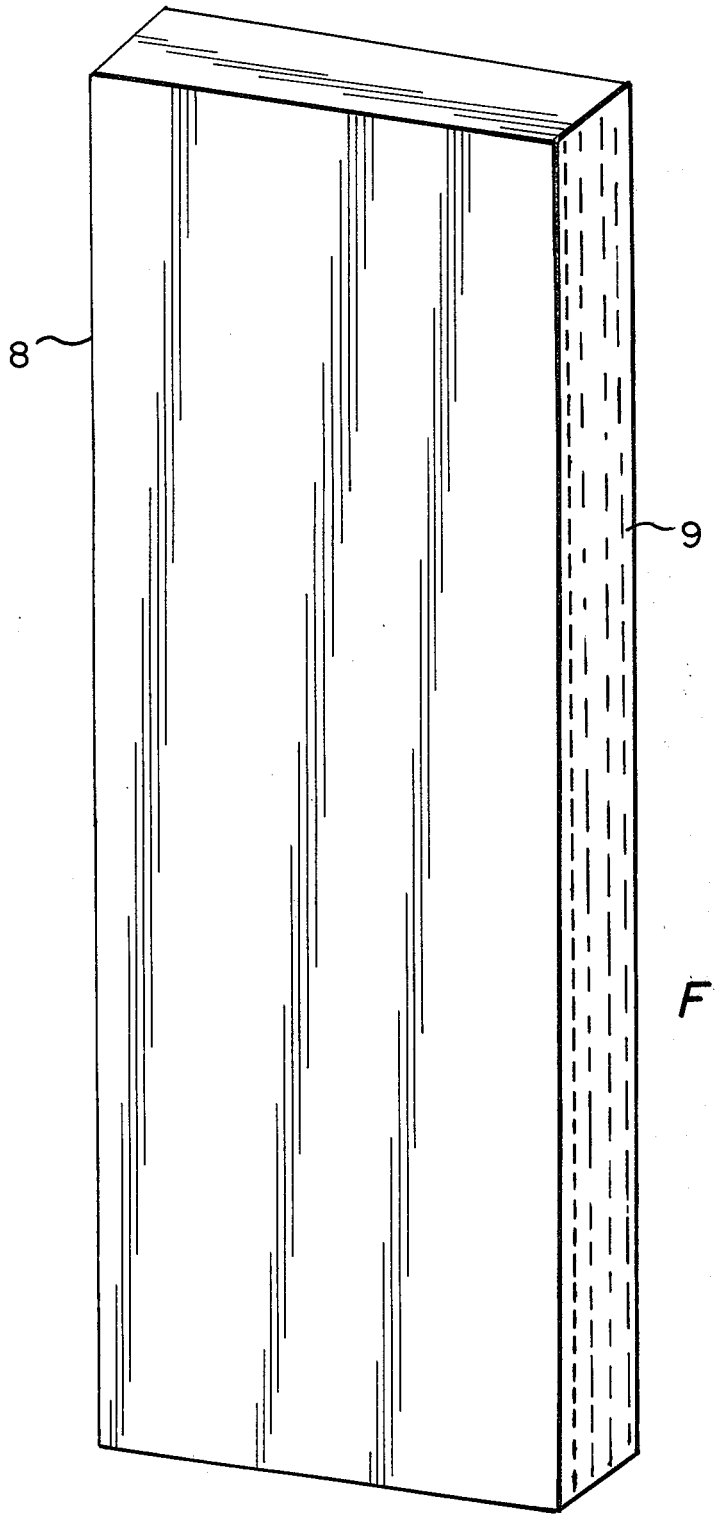

3 depicts the insulation layer. 4 depicts the leather layer. 5 depicts the rear paneling within the grooves in place. 8 depicts the 'cool container' housed within the vacant space (chamber). FIG. 4 contains a three dimensional view of the 'cool container' which contains the refrigerant.

9 depicts the refrigerant contained within the 'cool container' 8 depicts the 'cool container'.

Describing now the operation of the right 'foot cooler':

1. The subject places the 'cool container'(8) overnight in the ice cube compartment of an operating refrigerator to chill.

2. The subject removes the 'cool container'(8) from the refrigerator in the morning for its placement inside the vacant space(chamber)(2) of the right 'cool shoe'-FIG. 1.

3. The subject slides the rear paneling(5) at the rear side of the right 'cool shoe'-FIG. 3-which is fixed in position by the upper grove(6) and the lower groove(7), by pressing the rear paneling inwardly and pushing it outwardly, thereby sliding it within the upper and lower grooves, until it is completely removed from the grooves, revealing the open mouth of the 'cool shoe', at the rear of the shoe, and the vacant space (chamber)(2) inside, which is now ready to receive the 'cool container'(8).

4. The vacant space (chamber)(2) within the 'cool shoe'—FIG. 2—is 10 inches long, three and a quarter inches wide, at the narrowest point, and one inch high. The 'cool container' has the same dimensions, except for one quarter of an inch less in the height dimension. The vacant space (chamber) is insulated on all walls, sides, with a flexible material such as cork or stirofoam, and also insulated at the floor with the same material. The insulation is flexible enough to allow the 'cool container' to be maneuvered all the way into the vacant space(chamber). The insulation layer(3) insulates the vacant space(chamber)(2) by preventing the hot air outside the high outer platform sole(2 to 7) to pass into the vacant space(chamber)(2) and at the same time prevents the cold air inside the vacant space(chamber)(2) refrigerated by the 'cool container'(8) from passing through the walls and floor of the vacant space(chamber)(2).

5. The layer of leather joined to the layer of rubber foam, to form the inner sole, that separates the subject's foot, within the shoe compartment(1) of the right 'cool shoe'—FIG. 1—from the high outer platform sole, below(2 to 7) is sufficiently soft and flexible to allow for foot comfort but insufficiently insulated to prevent the flow of heat transfer from the foot above the inner sole to the chilly refrigerant contained in the 'cool container'(8) below the inner sole. The insulation layer(3) is joined to the leather layer(4) on all the walls and the floor surrounding the vacant space(chamber)(2) by gluing. The layer of leather joined to the layer of rubber foam to form the inner sole is joined by gluing. According to the second law of thermodynamics, the heat will flow from the body contain the higher temperature, in our case the subject's foot, to the body or substance containing the lower temperature, in our case the 'cool container' containing the chilly refrigerant, preferably freeon. The heat transfer will pass through the inner sole which is somewhat porous and insufficiently insulated to prevent the heat transfer from passing through and on down to the 'cool container'.

6. The subject holds the 'cool container'(8) in his hand, brings it up to the exposed mouth area at the rear of the high outer platform sole of the 'cool shoe'-FIG. 3-and inserts it completely within the vacant space(chamber)(2) until all of it is inside the 'cool shoe'.

7. The subject then returns the rear paneling(5) places it within the appropriate grooves, the upper groove(6) which holds the rear paneling from the top and the lower groove(7) which holds the rear paneling from the bottom, and slides it all the way to its original position, by pressing the rear paneling inwardly and pushing it outwardly, until the entire mouth of the rear wall of 'cool shoe' is closed.

8. In like manner the subject follows through steps 1 through 7 to prepare and insert the 'cool container', of the other shoe, the left 'cool shoe', inside the left 'cool shoe'.

9. The subject is now ready to cool his muggy hot feet or to prevent it from becoming hot and muggy. He dons his right sock and left sock, and then dons the right 'foot cooler', and the left 'foot cooler' in the same manner he would don an ordinary pair of shoes, with the same dimensions and shape as the 'cool shoes'.

10. The subject is capable of walking, running, jumping, climbing, standing and sitting without limitations of ambulation, without restrictions of movement, and without restraints in mobility, while his feet is being cooled, within the pair of 'foot coolers'. The 'cool container' is light-weight and weighs no more than three quarters of a pound when filled with the refrigerant.

11. The subject prevents his feet from becoming hot and muggy, while wearing the 'foot coolers'-the 'cool shoes' housing the 'cool containers'-eventhough he ventures outdoors under the hot sun or moves indoors in a hot non-airconditioned room, during the summer months.

12. The upper part of the 'cool shoe'(1) everything excluding the high platform outer sole,(2 through 7) is shoe compartment of the 'cool shoe'. It is constructed in the same fashion and the same material as an ordinary shoe, with the same shape and dimensions as the 'cool shoe'. It is only the high platform outer sole,(2 through 7) with its specially constructed vacant space(chamber)(2), sufficiently insulated around the walls and floor, to house a 'cool container', but insufficiently insulated at the ceiling, with a layer of leather joined to a layer of rubber foam, to prevent the heat transfer from the feet above the separation of the inner sole to pass through and down to the 'cool container', containing the chilly refrigerant, below the separation of the inner sole, that is different from the ordinary shoe.

13. The process of preventing the feet from becoming hot and muggy starts as soon as the subject places his feet well within the 'foot coolers'. The process of cooling hot and muggy feet ends several hours later, when the subject removes his feet from within the 'foot coolers'.

This method of preventing feet from becoming hot and muggy during the summer months can be applied by utilizing various liquid, solid, or vaporous refrigerants encased, entrapped, or enclosed within plastic, metal, rubber, or synthetic materials.

This method of cooling hot and muggy feet can also be applied by utilizing a miniature, mechanical, refrigerating device that uses a pump, manipulated by the power of the movement of the feet, or any other applicable source of power, that contains the basic parts of generator, separator, condenser, evaporator and absorber. 'cool shoes' by decreasing the inside temperature of the shoes and neutralizes the factors that cause feet perspiration and concomitant unpleasant feet odor.

The present method of preventing hot and muggy feet and cooling hot and muggy feet, is also applicable to the utilization of a miniature, mechanical, refrigerating device that uses a pump manipulated by the movement of the feet and that contains the basic parts of generator, separator, condenser, evaporator, and absorber.

What is claimed is:

1. A pair of cool shoes comprising: a high platform outer sole specially insulated within and specially constructed with a vacant chamber, which said chamber houses a durable, lightweight, removable container, which said container contains a chilly refrigerant that absorbs the heat transfer from the user's feet and passes it on down through the insufficiently insulated inner sole separating the user's feet from the cool container, to the chilly refrigerant contained within the said container.

* * * * *